US009751318B2

(12) United States Patent
Iwano et al.

(10) Patent No.: US 9,751,318 B2
(45) Date of Patent: Sep. 5, 2017

(54) LIQUID EJECTION APPARATUS AND ATTACHMENT ASSEMBLY OF LIQUID EJECTION APPARATUS

(71) Applicant: CANON KABUSHIKI KAISHA, Tokyo (JP)

(72) Inventors: Takuya Iwano, Inagi (JP); Hiromasa Amma, Kawasaki (JP); Takeshi Sekino, Yokohama (JP); Noboru Shimoyama, Yokohama (JP); Shuichi Hasegawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/156,808

(22) Filed: May 17, 2016

(65) Prior Publication Data

US 2016/0347076 A1 Dec. 1, 2016

(30) Foreign Application Priority Data

May 29, 2015 (JP) ..... 2015-110168
Feb. 17, 2016 (JP) ..... 2016-028308

(51) Int. Cl.
*B41J 2/175* (2006.01)

(52) U.S. Cl.
CPC ..... *B41J 2/17523* (2013.01); *B41J 2/175* (2013.01); *B41J 2/1752* (2013.01)

(58) Field of Classification Search
CPC . B41J 2/17523; B41J 2/17509; B41J 2/17506
See application file for complete search history.

(56) References Cited

U.S. PATENT DOCUMENTS 3,941,149 A * 3/1976 Mittleman ..... A61M 39/24 137/493.1
5,657,057 A 8/1997 Nakajima et al. ..... 347/7
6,033,062 A * 3/2000 Hotomi ..... B41J 2/17513 347/86
6,302,531 B1 * 10/2001 Usui ..... B41J 22/17523 347/86
6,631,982 B2 10/2003 Sasaki et al. ..... 347/85
7,090,341 B1 * 8/2006 Miyazawa ..... B41J 2/17503 137/852
7,111,931 B2 9/2006 Amma et al. ..... 347/86
7,350,910 B2 4/2008 Amma et al. ..... 347/86
7,384,116 B2 6/2008 Kotaki et al. ..... 347/19
7,445,322 B2 11/2008 Kitabatake et al. ..... 347/86
7,926,927 B2 4/2011 Kotaki et al. ..... 347/86
8,070,276 B2 12/2011 Amma ..... 347/87
8,109,617 B2 2/2012 Kotaki et al. ..... 347/86
(Continued)

FOREIGN PATENT DOCUMENTS

JP 2002-307713 10/2002

OTHER PUBLICATIONS

U.S. Appl. No. 15/153,388, filed May 12, 2016.

*Primary Examiner* — Stephen Meier
*Assistant Examiner* — John P Zimmermann
(74) *Attorney, Agent, or Firm* — Fitzpatrick Cella Harper & Scinto

(57) ABSTRACT

A holding member provided in a liquid ejection apparatus is attached to a receiving member and includes a capturing portion capturing a supply member so as to hold the supply member. The capturing portion is displaceable while the holding member is attached to the receiving member.

14 Claims, 14 Drawing Sheets

(56) References Cited

U.S. PATENT DOCUMENTS

| | | | | |
|---|---|---|---|---|
| 8,147,048 | B2 | 4/2012 | Amma | 347/87 |
| 8,528,604 | B2 * | 9/2013 | Hattori | B41J 2/17506 141/18 |
| 2004/0246304 | A1 | 12/2004 | Takahashi et al. | 347/49 |
| 2006/0017790 | A1 * | 1/2006 | Jin | B41J 2/17596 347/86 |

* cited by examiner

LIQUID EJECTION APPARATUS AND ATTACHMENT ASSEMBLY OF LIQUID EJECTION APPARATUS

BACKGROUND OF THE INVENTION

Field of the Invention

The present invention relates to a liquid ejection apparatus which supplies a liquid to a liquid ejection head through a tube or the like and ejects the liquid from the liquid ejection head and relates to an attachment assembly thereof.

Description of the Related Art

As an inkjet printing apparatus, there is known a tube supply type inkjet printing apparatus which supplies an ink from a main tank provided outside a carriage to a sub-tank mounted on the carriage through a tube and causes a liquid ejection head to eject the ink supplied to the sub-tank. Such a tube supply type inkjet printing apparatus that supplies an ink to a sub-tank is disclosed in Japanese Patent Laid-Open No. 2002-307713. In the inkjet printing apparatus disclosed in Japanese Patent Laid-Open No. 2002-307713, a needle-shaped ink supply member is inserted into a small hole and the ink is supplied from a tube into the sub-tank through the ink supply member.

In the inkjet printing apparatus disclosed in Japanese Patent Laid-Open No. 2002-307713, the small hole into which the supply member supplying the ink to the sub-tank is inserted is formed in an outer wall forming the sub-tank. Thus, a position of the small hole is limited and the small hole is formed so that the position is not simply displaced. For that reason, high positioning precision is needed in the supply member when the supply member is inserted into the small hole. In accordance with this configuration, the inkjet printing apparatus disclosed in Japanese Patent Laid-Open No. 2002-307713 includes a mechanism used to position the supply member and the small hole. However, when there is an attempt to improve the positioning precision, the configuration becomes complex and hence the manufacturing cost of the inkjet recording apparatus (liquid ejection apparatus) may increase. Further, it is desirable to suppress the leakage of the ink (liquid) even when a positional deviation occurs between the supply member and the small hole due to a certain reason.

SUMMARY OF THE INVENTION

The present invention provides a liquid ejection apparatus capable of supplying a liquid from a supply member to a liquid ejection head by a simple configuration and to provide an attachment assembly thereof.

In the first aspect of the present invention, there is provided a liquid ejection apparatus comprising:

a supply member that includes a supply opening and is able to supply a liquid from the supply opening;

a liquid ejection head that is able to eject a liquid;

a receiving member that is connected to the liquid ejection head, is able to receive the supply member, and is able to supply the liquid supplied from the supply member to the liquid ejection head in a case where the receiving member receives the supply member; and a holding member that is attached to the receiving member and includes a capturing portion capturing the supply member so as to hold the supply member, wherein the capturing portion is urged in a direction in which the supply member is captured, and wherein the capturing portion is displaceable while the holding member is attached to the receiving member.

In the second aspect of the present invention, there is provided an attachment assembly, for a liquid supply portion, provided in a liquid ejection apparatus including a liquid ejection head ejecting a liquid, comprising:

a supply member that includes a supply opening and is able to supply the liquid from the supply opening;

a receiving member that is able to receive the supply member and receives the liquid from the supply member in a case where the receiving member receives the supply member; and a holding member that is attached to the receiving member and includes a capturing portion capturing the supply member so as to hold the supply member, wherein the capturing portion is urged in a direction in which the supply member is captured, and wherein the capturing portion is displaceable while the holding member is attached to the receiving member.

According to the present invention, it is possible to provide the liquid ejection apparatus capable of efficiently supplying the liquid from the supply member toward the liquid ejection head by a simple configuration and manufactured at low cost and to provide the attachment assembly thereof.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

First Embodiment

Figure 1:
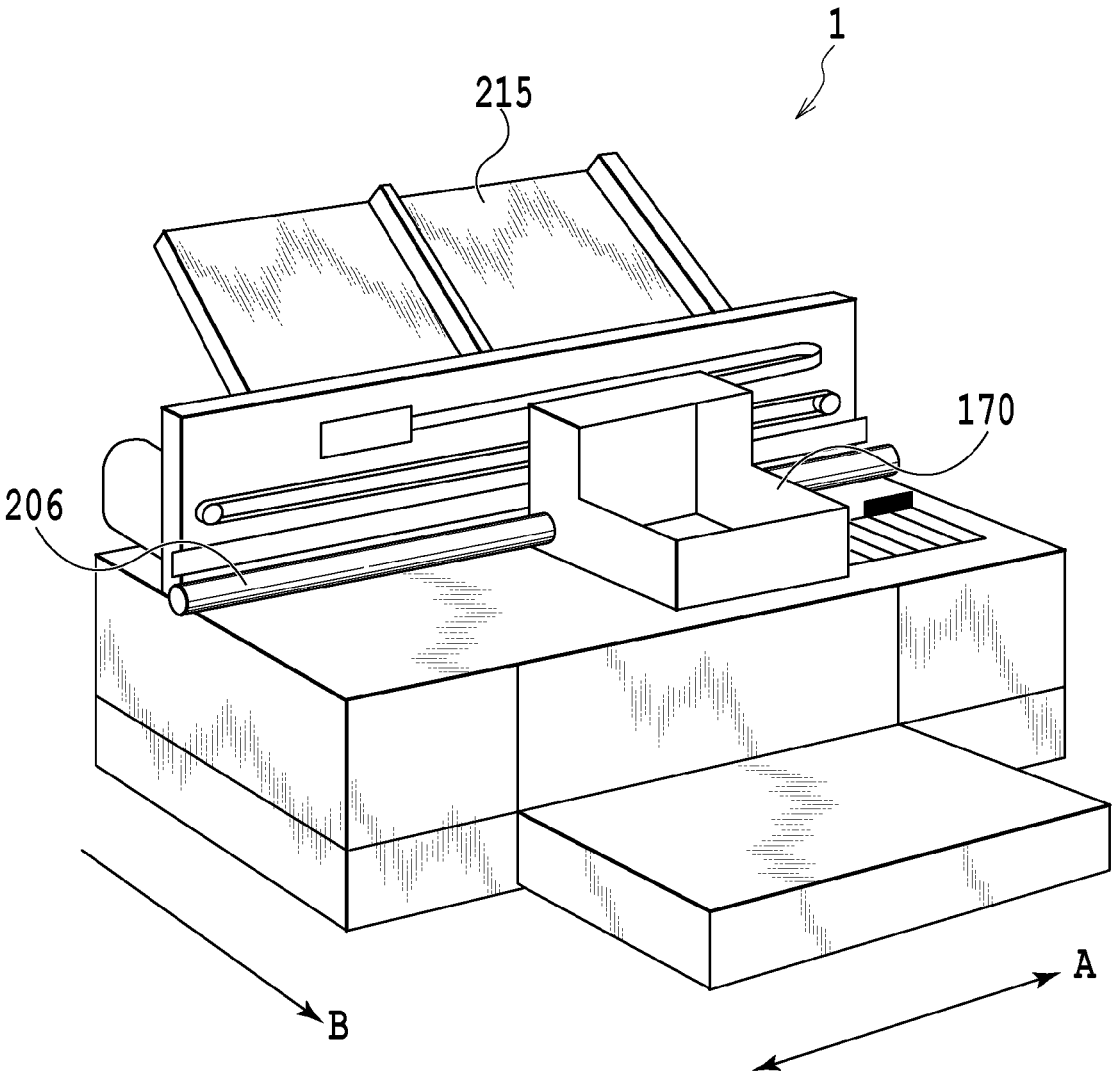
FIG. 1 is a perspective view illustrating a liquid ejection apparatus according to a first embodiment of the present invention.

First, a liquid ejection apparatus capable of being equipped with a liquid ejection head according to a first embodiment of the present invention will be described. FIG. 1 is a perspective view illustrating a liquid ejection apparatus 1 capable of being equipped with a liquid ejection head of the present embodiment. In the liquid ejection apparatus 1 of the present embodiment, the liquid ejection head can be mounted inside a carriage 170.

Although not illustrated in FIG. 1, a main tank is attached to a position different from the carriage 170 in the liquid ejection apparatus 1 of the present embodiment. When the liquid ejection head capable of ejecting a liquid is mounted on the carriage 170, the liquid ejection head and the main tank are connected through a tube. In the present embodiment, an ink can be supplied from the main tank to a sub-tank of the liquid ejection head through a tube.

Figure 2:
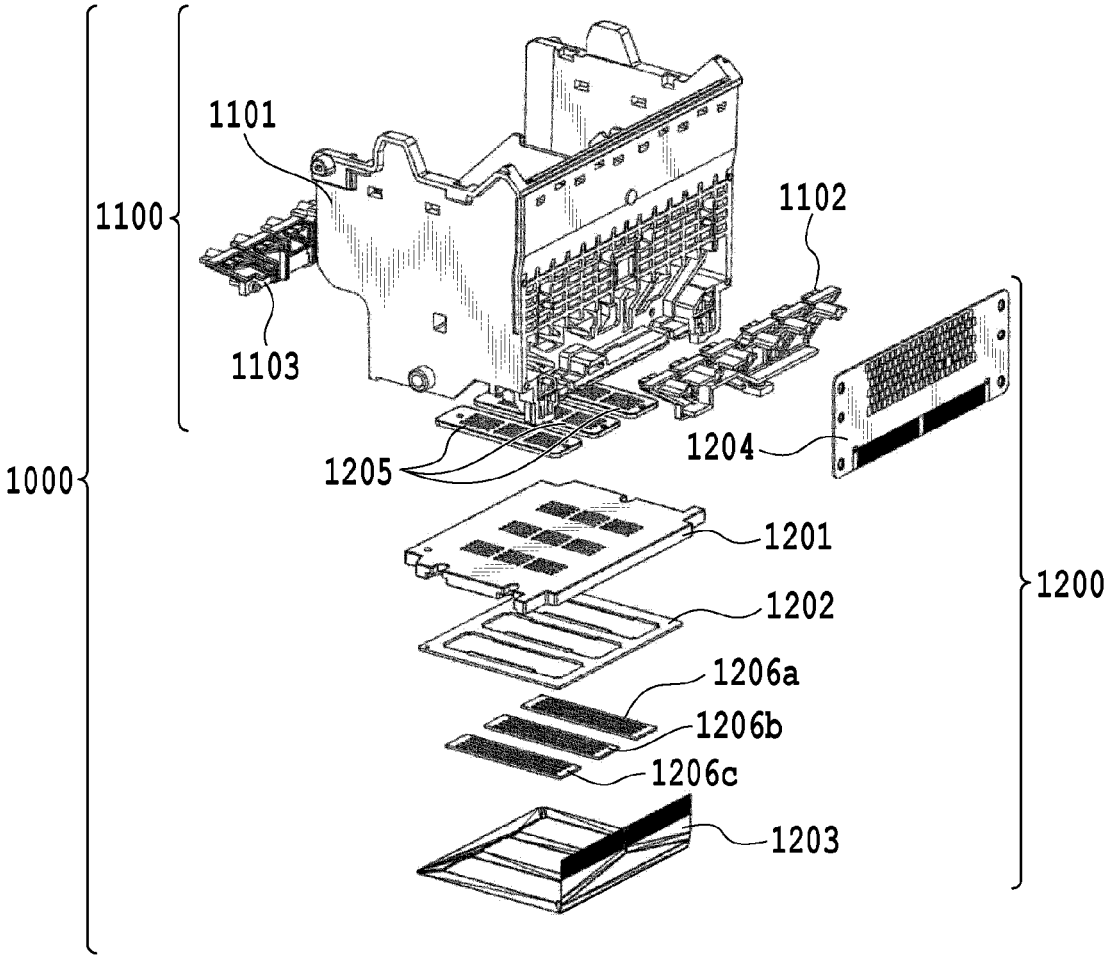
FIG. 2 is an exploded perspective view illustrating a liquid ejection head mounted on a carriage of the liquid ejection apparatus of FIG. 1.
Figure 3:
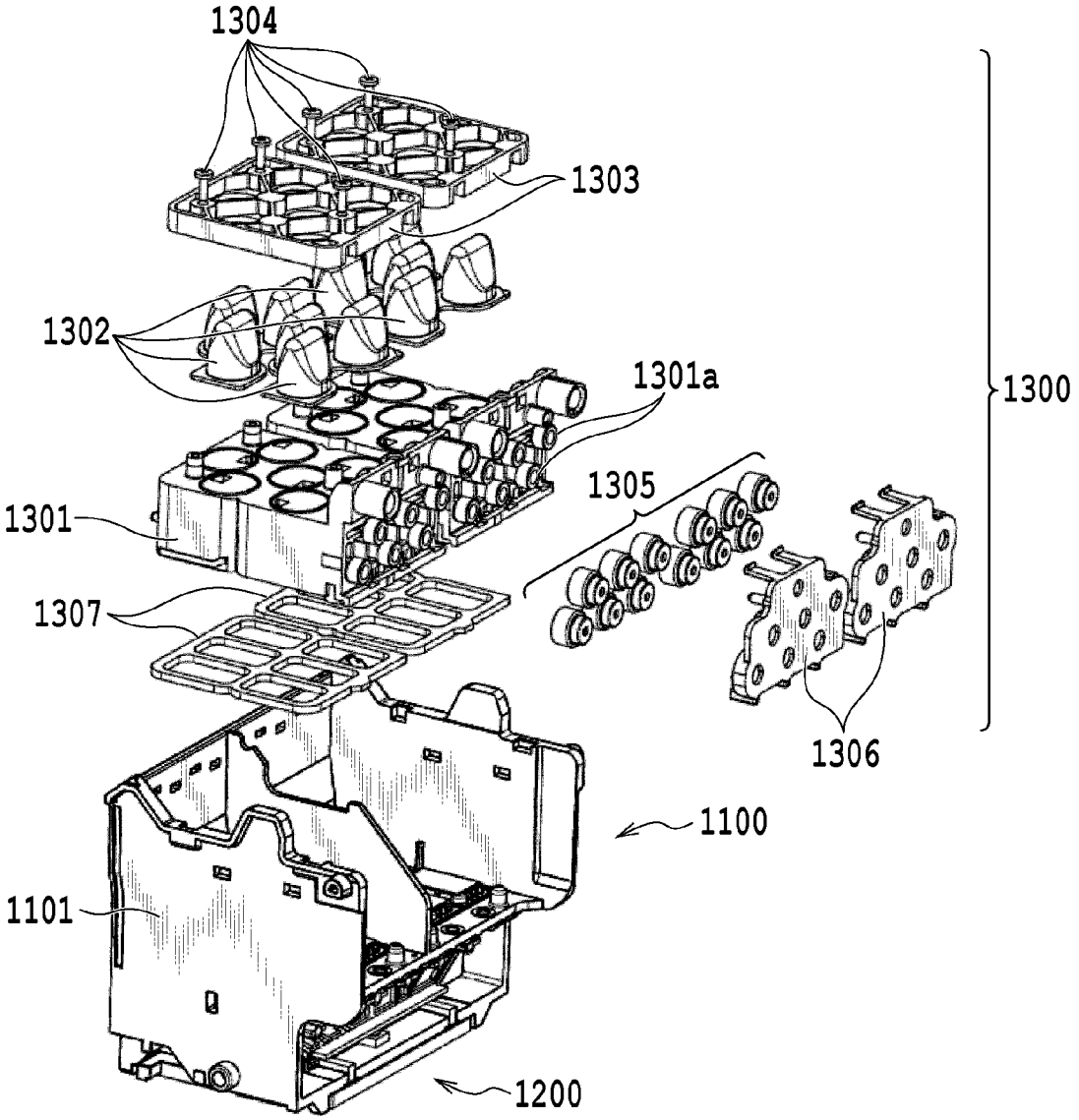
FIG. 3 is an exploded perspective view illustrating an ink storage unit of the liquid ejection head of FIG. 2.

FIG. 2 is an exploded perspective view illustrating a liquid ejection head 1000 mounted on the carriage 170 of the liquid ejection apparatus 1. The liquid ejection head 1000 of the present embodiment includes an ink supply unit 1100 and a printing element unit 1200 receiving an ink as a printing liquid (liquid) from the ink supply unit 1100 and ejecting the ink. FIG. 3 is an exploded perspective view illustrating an ink storage unit 1300 connected to the liquid ejection head 1000 and temporarily storing the ink supplied into the liquid ejection head 1000.

The liquid ejection head 1000 is attached to the carriage 170 of the liquid ejection apparatus 1 while being positioned by a positioning member (not illustrated). At this time, since the liquid ejection head 1000 and the carriage 170 are positioned with high precision, electrical contacts therebetween are reliably connected to each other and the liquid ejection head 1000 is supported by the carriage 170 in a fixed state. Further, the liquid ejection head 1000 is removably attached to the carriage 170.

The ink supply unit 1100 includes a casing 1101 which holds the ink storage unit 1300. The ink storage unit 1300 is provided so as to temporarily store an ink supplied from a main body of the liquid ejection apparatus as a printer body. Further, the ink supply unit 1100 includes a passage forming member 1102 which guides an ink from the sub-tank toward the printing element unit 1200. The printing element unit 1200 includes three printing element substrates 1206 (1206*a*, 1206*b*, and 1206*c*). Further, the printing element unit 1200 includes a first support member 1201 and a second support member 1202.

The second support member 1202 is provided with three penetration openings corresponding to three printing element substrates 1206. The second support member 1202 is adhered to the first support member 1201. The printing element substrates 1206*a*, 1206*b*, and 1206*c* are adhered and fixed to the first support member 1201 while being disposed inside three penetration openings of the second support member 1202. Further, an electrical wiring tape 1203 is adhered to the second support member 1202.

The electrical wiring tape 1203 is electrically connected to the printing element substrates 1206*a*, 1206*b*, and 1206*c* so that electrodes respectively formed in the printing element substrates 1206*a*, 1206*b*, and 1206*c* are connected to the corresponding contacts of the electrical wiring tape 1203. That is, the printing element substrate 1206 is held by the first support member 1201 and the second support member 1202 so that the electrical wiring tape 1203 and the printing element substrate 1206 are electrically connected to each other through the second support member 1202.

An electrical contact substrate 1204 is attached to the casing 1101 while the electrical contact substrate 1204 is electrically connected to the electrical wiring tape 1203. In the present embodiment, when an end of the electrical wiring tape 1203 and the electrical contact substrate 1204 having an external signal input terminal for receiving an electric signal from the main body of the liquid ejection apparatus 1 are thermally bonded by using an anisotropic conductive film or the like, these are electrically connected.

The electrical wiring tape 1203 applies an electric signal for ejecting an ink to the printing element substrates 1206 in order to eject ink droplets from a predetermined ejection opening by driving a predetermined heater in response to image information. The electrical wiring tape 1203 includes an electric wire corresponding to the printing element substrate 1206 and an external signal input terminal located at the electric wire so as to receive an electric signal from the printer body. The external signal input terminal of the electrical wiring tape 1203 is positioned and fixed at a rear surface of the casing 1101.

In the printing element substrates 1206 (1206*a* to 1206*c*) of the printing element unit 1200, an energy generation element for generating ejection energy is provided in one surface of a Si substrate having a thickness of 0.5 to 1 mm and facing a printing medium in order to eject a liquid ink. In the present embodiment, ink droplets are ejected from the ejection opening formed in the printing element substrate 1206 in a manner such that heaters (heating resistance elements) as electro thermal converters are used as the energy generation elements. Further, the heaters and the electric wires supplying electric power to the heaters are formed on the printing element substrate 1206 by a film deposition technology. Then, the ink passages and the ejection openings corresponding to the heaters are formed in the printing element substrate 1206 by a photolithography technology. Further, ink supply openings for supplying ink to the ink passages are opened in the rear surface of each printing element substrate 1206. A sealant is coated on an electrical connection portion between the printing element substrate 1206 and the electrical wiring tape 1203. Since the electrical connection portion is sealed with the sealant, the electrical connection portion is protected from the corrosion or the external shock of the ink.

The ink storage unit 1300 includes a sub-tank 1301 (receiving member) which temporarily stores an ink supplied from the main body and supplies the stored ink to the ink supply unit 1100. Further, the ink storage unit 1300 includes pressure damping members 1302 each of which decreases a change in pressure inside an ink supply passage and cover members 1303 and screws 1304 which are used to couple and fix the pressure damping members 1302 and the sub-tanks 1301 to each other. Further, the ink storage unit 1300 includes soft members (holding members) 1305 forming an ink supply joint and cover member 1306*s* covering the soft members 1305.

The ink supply unit 1100 and the ink storage unit 1300 are coupled and fixed by screws (not illustrated) through an elastic member 1307. The sub-tank 1301 is provided with six separate liquid chambers, and the pressure damping members 1302 is disposed so as to communicate with each liquid chambers of the sub-tank 1301. Thus, six pressure damping members 1302 are attached to the sub-tank 1301 so as to correspond to six liquid chambers. The inside of each pressure damping member 1302 communicates with each liquid chamber of the sub-tank 1301, and a pressure damping chamber is formed between the pressure damping member 1302 and the liquid chamber. Further, the pressure damping member 1302 is formed so as to be integrated with three adjacent pressure damping chambers. When the pressure damping member 1302 is nipped between the sub-tank 1301 and the cover member 1303 and is coupled and fixed by three screws 1304 provided in each cover member 1303, the pressure damping member 1302 is attached to the sub-tank 1301. The ink storage unit 1300 is formed in this way and each liquid chamber of the sub-tank 1301 is connected to each pressure damping chamber inside the pressure damping member 1302.

The carriage 170 is guided along a guide shaft 206 so as to be movable in a main scan direction of the arrow A. The guide shaft 206 is disposed so as to extend in a width direction of the printing medium. The liquid ejection head 1000 mounted on the carriage 170 performs a printing process while scanning a direction intersecting to the conveying direction in which the printing medium is conveyed. In this way, the liquid ejection apparatus 1 is a so-called serial scan type printing apparatus that prints an image in accordance with the movement of the liquid ejection head 1000 in the main scan direction and a conveying operation of the printing medium in a sub-scan direction. The printing medium is stacked on a sheet feeding unit 215 and is conveyed in the sub-scan direction of the arrow B by a conveying roller. The liquid ejection apparatus 1 sequentially prints an image on the printing medium by repeating a printing operation of ejecting a liquid (ink) while moving the liquid ejection head 1000 in the main scan direction and a conveying operation of conveying a printing medium in the sub-scan direction.

When the liquid is ejected, the heating resistance elements are driven while the liquid is stored in the liquid chamber formed in the printing element substrate 1206 of the liquid ejection head 1000. In response to printing data, a current is supplied to the heating resistance element of the printing element substrate 1206 through a wire at a predetermined timing. Since the current is supplied to the heating resistance element, the heating resistance element is driven. The liquid which receives thermal energy by the driving of the heating resistance element is film-boiled inside the liquid chamber. Accordingly, the liquid is ejected from the ejection opening toward the printing medium so as to print an image on the printing medium.

The above-described liquid ejection apparatus 1 is a so-called serial scan type liquid ejection apparatus which prints an image in accordance with the movement of the liquid ejection head 1000 in the main scan direction and the conveying operation of the printing medium in the sub-scan direction. However, the present invention can be also applied to a full line type liquid ejection apparatus which uses a liquid ejection head extending in an entire area of the width direction of the printing medium.

Further, the liquid ejection head 1000 of the present embodiment is used to eject ink droplets by bubbling a liquid using the heating resistance element, but the present invention is not limited thereto. For example, a liquid ejection head ejecting a liquid therein by using a piezoelectric element or a liquid ejection head ejecting a liquid therein by using other elements may be used.

Next, a connection portion between the soft member 1305 and a receiving member 1301*a* of the sub-tank 1301 and a connection portion between the soft member 1305 and a front end of an ink supply tube of an ink supply needle 1401 of the present embodiment will be described.

Figure 4:
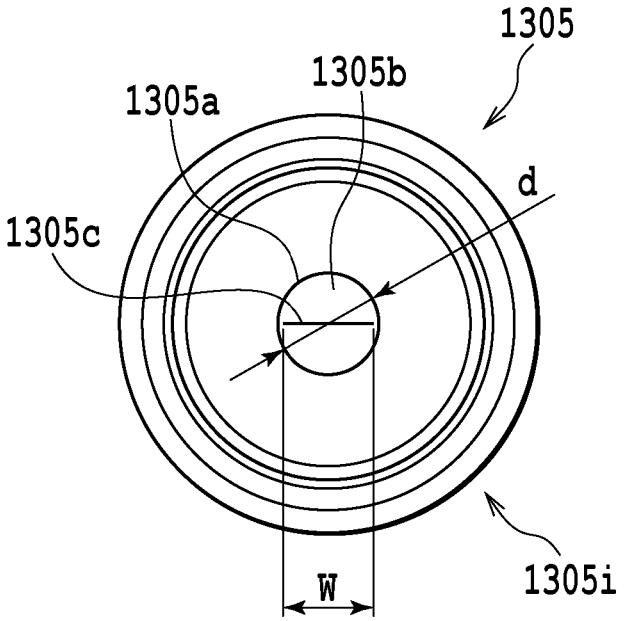
FIG. 4 is a front view illustrating a soft member of the ink storage unit of FIG. 3.

FIG. 4 is a front view, when viewed from the ink supply direction, illustrating the soft member 1305 used to connect the ink supply needle 1401 and the sub-tank 1301 to each other. As illustrated in FIG. 4, the soft member 1305 is formed in a cylindrical shape, and a supply member insertion opening (first insertion opening) 1305*a* is formed in a portion into which the ink supply needle 1401 is inserted.

Further, in the soft member 1305, a closing thin film (film member) 1305*b* and a slit 1305*c* are formed in a surface facing the ink supply needle 1401. The closing thin film 1305*b* of the present embodiment is formed so as to have elasticity. The closing thin film 1305*b* of the present embodiment is formed at two positions and the closing thin films 1305*b* are formed at the opposite positions with the center of the supply member insertion opening 1305*a* interposed therebetween. As will be described later, the soft member 1305 includes a capturing portion 1305*i* capable of capturing the ink supply needle 1401 by including the insertion opening 1305*a* and the closing thin film 1305*b*.

Figure 5A:
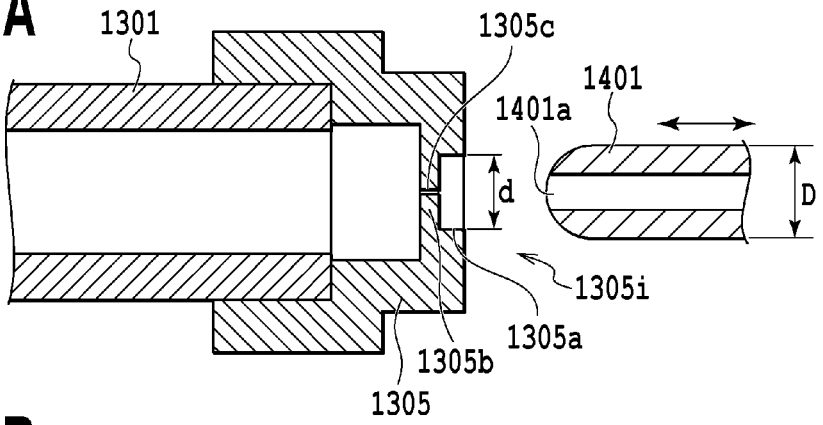
FIG. 5A is a cross-sectional view illustrating a sub-tank, a soft member, and an ink supply needle of FIG. 3.

FIG. 5A is a cross-sectional view illustrating a connection portion between the sub-tank 1301 and the ink supply needle 1401 of the ink supply tube for supplying the ink from the main tank toward the liquid ejection head 1000. The receiving member 1301*a* that extends from the sub-tank 1301 toward the ink supply needle 1401 is formed in a cylindrical shape. The receiving member 1301*a* of the sub-tank 1301 is formed so that the ink supply needle 1401 is received into an end near the printing head (one end).

The ink supply needle (supply member) 1401 supplies the ink fed from the main tank toward the sub-tank. The ink supply needle 1401 is provided with a supply opening 1401*a* which supplies the ink toward the sub-tank 1301. In the present embodiment, the ink supply needle 1401 is formed in a needle shape and the supply opening 1401*a* is formed in a front end of the ink supply needle 1401.

Further, the soft member 1305 is attached to an end of the receiving member 1301*a* near the ink supply needle 1401. A receiving member insertion opening (second insertion opening) 1305*h* (FIG. 5B) is opened in the end of the soft member 1305 near the sub-tank 1301 so that the receiving member 1301*a* of the sub-tank 1301 is inserted thereinto. In this way, the soft member 1305 includes the insertion opening 1305*h* into which the end of the receiving member

1301*a*, that is, an end opposite to the connection side of the liquid ejection head 1000 is inserted. When the receiving member 1301*a* of the sub-tank 1301 is inserted into the insertion opening 1305*h*, the soft member 1305 is attached to the sub-tank 1301. In the present embodiment, the sub-tank 1301 and the ink supply needle 1401 are formed as molded parts and the soft member 1305 is formed as a rubber part.

Figure 5B:
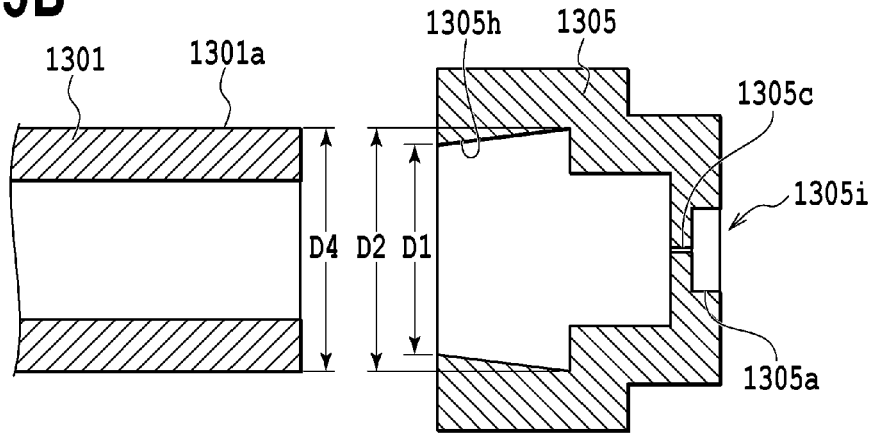
FIG. 5B is a main cross-sectional view illustrating a state where the soft member is not attached to the sub-tank.

FIG. 5B is a cross-sectional view illustrating the soft member 1305 and the receiving member 1301*a* of the sub-tank 1301 in a state where the soft member 1305 is not attached to the sub-tank 1301. As illustrated in FIG. 5B, an outer diameter of the end of the receiving member 1301*a* is larger than an inner diameter of the insertion opening 1305*h* of the soft member 1305. Further, the inner diameter of the insertion opening 1305*h* decreases as it goes toward the sub-tank 1301 in a state where the soft member 1305 is not attached to the sub-tank 1301. An outer shape of the receiving member 1301*a* is formed uniformly. Accordingly, a difference between an outer face of the receiving member 1301*a* and the inner diameter of the insertion opening 1305*h* increases as it goes toward the liquid ejection head 1000 in a state where the soft member 1305 is not attached to the sub-tank 1301. With this configuration, the receiving member 1301*a* is fitted to the insertion opening 1305*h* and the soft member 1305 is attached to the receiving member 1301*a*.

In the present embodiment, the outer shape of the receiving member 1301*a* is uniform and the inner diameter of the insertion opening 1305*h* of the soft member 1305 decreases as it goes toward the sub-tank 1301. Regarding the inner diameter of the insertion opening 1305*h*, the inner diameter at a position nearest the sub-tank 1301 is indicated by D1 and the inner diameter at a position nearest the ink supply needle 1401 is indicated by D2. As illustrated in FIG. 5B, a relation of D1≤D2 is established.

Figure 5C:
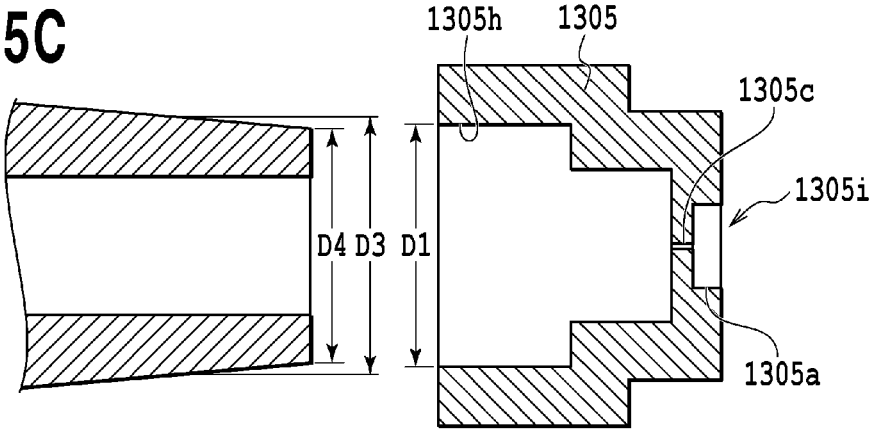
FIG. 5C is a cross-sectional view illustrating a receiving member and a soft member according to a modified example.

Furthermore, the present invention is not limited thereto, as illustrated in FIG. 5C, the inner diameter of the insertion opening 1305*h* may be uniform and the outer diameter of the receiving member 1301*a* may increase as it goes toward the sub-tank 1301. Regarding the outer diameter of the receiving member 1301*a* of the sub-tank 1301, the outer diameter at a position nearest the ink supply needle 1401 is indicated by D4. Further, regarding the outer diameter of the receiving member 1301*a*, the outer diameter at a position nearest the sub-tank 1301 in a portion contacting the inner wall of the insertion opening 1305*h* is indicated by D3. As illustrated in FIG. 5C, a relation of D4≤D3 is established.

Further, in the present embodiment, a case is described in which the outer diameter of the receiving member 1301*a* or the inner diameter of the insertion opening 1305*h* is uniform. However, the present invention is not limited thereto, and the outer diameter of the receiving member 1301*a* and the inner diameter of the insertion opening 1305*h* may be changed. In that case, since a relation of D1≤D2 and D4≤D3 is established, it is desirable to establish a relation of (D4−D2)≤(D3−D1). Accordingly, the clamping force of the sealing connection portion between the sub-tank 1301 and the soft member 1305 increases as it goes toward the insertion direction of the ink supply needle 1401.

A diameter d of the supply member insertion opening 1305*a* is smaller than a diameter D of the ink supply needle 1401. Further, since a width W of the slit 1305*c* is smaller than the diameter d of the insertion opening 1305*a*, the slit 1305*c* is positioned inside the insertion opening 1305*a*.

Figure 6A:
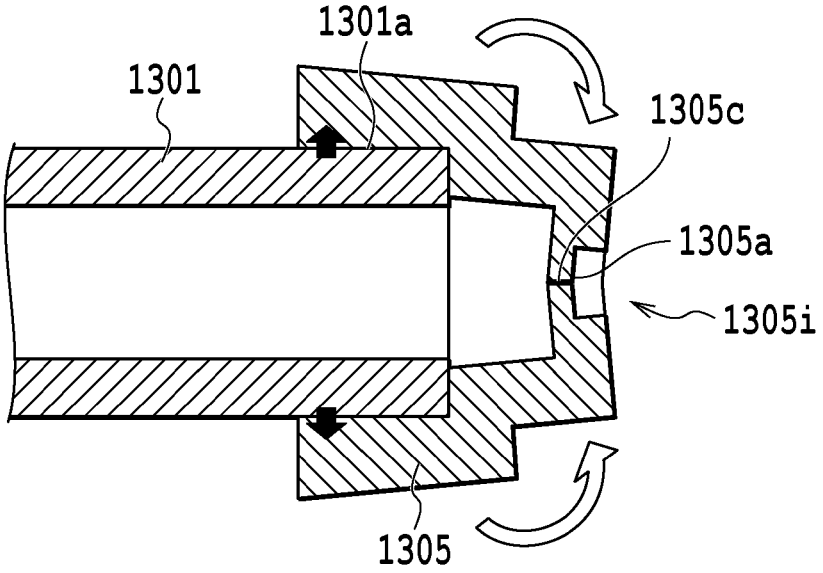
FIG. 6A is a main cross-sectional view illustrating a non-insertion state of an ink supply needle.

FIG. 6A is a cross-sectional view illustrating the receiving member 1301*a* and the soft member 1305 in a state where the soft member 1305 is attached to the receiving member 1301*a*. In a state before the receiving member 1301*a* being received into the insertion opening 1305*h*, the outer diameter of the receiving member 1301*a* is larger than the inner diameter of the insertion opening 1305*h* at a position of the end near the sub-tank 1301 in the insertion opening 1305*h*. Thus, when the receiving member 1301*a* is inserted into the insertion opening 1305*h*, the receiving member 1301*a* is press-inserted into the insertion opening 1305*h* and the receiving member 1301*a* is attached to the soft member 1305 while the soft member 1305 is elastically deformed. When the receiving member 1301*a* is inserted into the insertion opening 1305*h*, the insertion opening 1305*h* is widened outward. Thus, the soft member 1305 clamps the receiving member 1301*a* therein by an elastic force and hence the receiving member 1301*a* and the insertion opening 1305*h* are connected to each other in a sealed state. Further, as described above, the relation of (D4−D2)≤(D3−D1) is established in the connection portion between the sub-tank 1301 and the soft member 1305. For that reason, the clamping force of the soft member 1305 with respect to the receiving member 1301*a* of the sub-tank 1301 increases as it goes toward the insertion direction of the ink supply needle 1401.

The deformation amount of the soft member 1305 increases as it goes toward the insertion direction of the ink supply needle 1401. At this time, since the insertion opening 1305*h* is widened outward, a portion near the ink supply needle 1401 in the soft member 1305 is compressed inward as illustrated in FIG. 6A. Accordingly, a portion that receives the ink supply needle 1401 in the soft member 1305 is urged toward the supply member insertion opening 1305*a*. In accordance with this operation, the closing thin film 1305*b* formed in the insertion opening 1305*a* is urged inward.

Figure 6B:
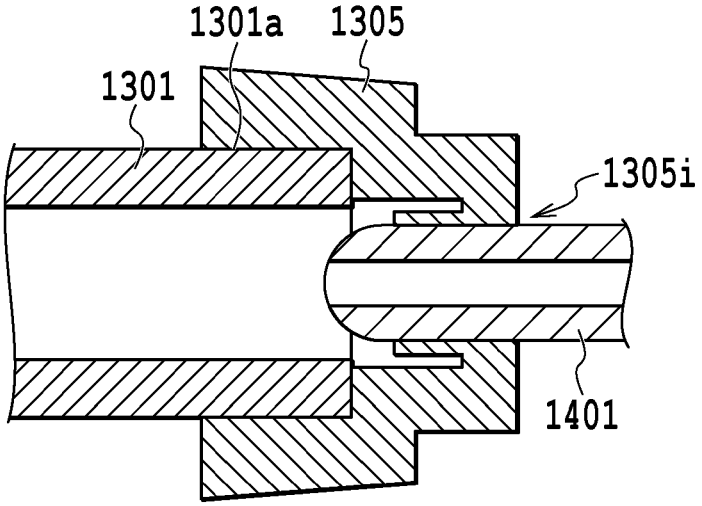
FIG. 6B is a main cross-sectional view illustrating an insertion state of the ink supply needle.

FIG. 6B is a cross-sectional view illustrating the connection portion in a state where the soft member 1305 is attached to the receiving member 1301*a* and the ink supply needle 1401 is inserted into the insertion opening 1305*a* of the soft member 1305. In a state where the ink supply needle 1401 is not inserted into the insertion opening 1305*a*, the inner diameter of the insertion opening 1305*a* is smaller than the outer shape of the ink supply needle 1401. Further, when the soft member 1305 is attached to the receiving member 1301*a*, a portion of the soft member 1305 receiving the ink supply needle 1401 by the insertion opening 1305*a* is urged inward. For that reason, when the ink supply needle 1401 is inserted into the insertion opening 1305*a*, the soft member 1305 presses the ink supply needle 1401 inward in the entire area of the circumferential direction of the ink supply needle 1401.

When the ink supply needle 1401 is inserted into the insertion opening 1305*a* of the soft member 1305, the ink supply needle 1401 passes through the insertion opening 1305*a* while opening the insertion opening 1305*a*. Further, the ink supply needle 1401 is inserted into the insertion opening 1305*a* while widening the slit 1305*c* formed between the closing thin films 1305*b*. Accordingly, the outer surface of the ink supply needle 1401 and the inner surface of the insertion opening 1305*a* continuously come into surface-contact with each other and hence the sealed state is ensured.

Figure 6C:
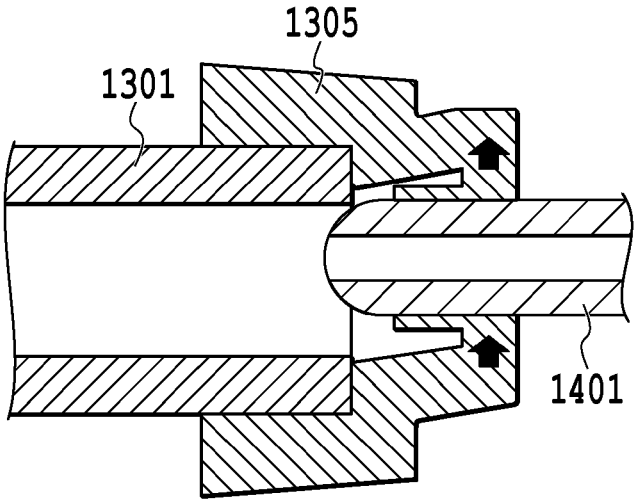
FIG. 6C is a main cross-sectional view illustrating a deviation state of the ink supply needle.

FIG. 6C is a cross-sectional view illustrating the connection portion when the ink supply needle 1401 is inserted into the insertion opening 1305*a* while the center position of the ink supply needle 1401 is deviated from the center of the insertion opening 1305*a*. When the ink supply needle 1401 is inserted into the insertion opening 1305*a* while the center position of the ink supply needle 1401 is deviated from the center position of the insertion opening 1305*a*, the position of the insertion opening 1305*a* can be displaced due to the elasticity of the soft member 1305.

Since the position of the insertion opening 1305*a* can be displaced in response to the deviation of the ink supply needle 1401, the high positioning precision of the ink supply needle 1401 is not needed when the ink supply needle 1401 is inserted into the insertion opening 1305*a*. For that reason, there is no need to provide a particular positioning mechanism in order to insert the ink supply needle 1401 into the insertion opening 1305*a*. For that reason, the configuration of the liquid ejection apparatus can be simplified.

Further, a peripheral portion of the insertion opening 1305*a* of the soft member 1305 is urged toward the center of the insertion opening 1305*a*. Thus, even when the ink supply needle 1401 is inserted into the insertion opening 1305*a* while being deviated from the center position of the insertion opening 1305*a*, a gap is not easily formed between the ink supply needle 1401 and the soft member 1305.

Further, in the present embodiment, the ink supply needle 1401 is inserted into the insertion opening 1305*a* while the ink supply needle 1401 and the soft member 1305 contact each other. Thus, when the ink is supplied to the liquid ejection head 1000 through the ink supply needle 1401, it is possible to suppress a problem in which the ink leaks from a gap between the ink supply needle 1401 and the soft member 1305 and dust or the like intrudes into the soft member 1305 from the outside.

According to the above-described configuration, it is possible to ensure the high sealing property of the connection portion even in the insertion operation while the connection portion of the ink supply joint portion is not highly precisely positioned. Further, the closing thin film 1305*b* is urged to the soft member 1305 so as to block the insertion opening 1305*a*. Thus, a force is applied to the closing thin film 1305*b* in the closing direction after the ink supply needle 1401 is removed from the insertion opening 1305*a*. Thus, when the ink supply needle 1401 is removed from the insertion opening 1305*a*, the closing thin film 1305*b* immediately blocks the insertion opening 1305*a* so as to suppress the leakage of the ink from the insertion opening 1305*a*. Further, it is possible to suppress dust or the like from intruding into the soft member 1305 when the ink supply needle 1401 is removed from the insertion opening 1305*a*. In this way, it is possible to ensure the sealing property of the soft member 1305.

Further, it is possible to suppress dust or the like from intruding into the ink when the ink is supplied to the liquid ejection head 1000. Thus, it is possible to cleanly keep the ink supplied to the liquid ejection head 1000. Accordingly, since the ink stored in the sub-tank 1301 is kept clean, it is possible to keep the high quality of the ink ejected from the liquid ejection head 1000.

Further, the soft member 1305 has elasticity. Thus, even when the ink supply needle 1401 is inserted into the insertion opening 1305*a* while the center position of the ink supply needle 1401 is deviated from the center position of the insertion opening 1305*a*, the elastic force of the soft member 1305 is applied to the ink supply needle 1401. A force, which causes the ink supply needle 1401 to return toward the center of the insertion opening 1305*a*, is applied to the ink supply needle 1401. Thus, even when the ink supply needle 1401 is inserted into the insertion opening 1305*a* while the center position of the ink supply needle 1401 is deviated from the center position of the insertion opening 1305*a*, the position of the ink supply needle 1401 can be returned to the center. Thus, the ink supply needle 1401 can be disposed at an appropriate position inside the soft member 1305.

Furthermore, the ink supply type can be used in any one of a pressurization supply type and a depressurization supply type, but the depressurization supply type is more desirable.

Second Embodiment

Next, a liquid ejection apparatus according to the second embodiment of the present invention will be described. A configuration similar to the first embodiment will not be described and only a configuration different from the first embodiment will be described.

In the first embodiment, a case has been described in which the inner diameter of the insertion opening 1305*h* of the soft member 1305 decreases as it goes toward the sub-tank 1301 due to the inclination of the inner wall surface of the receiving member insertion opening 1305*h*. Further, a case has been described in which the outer diameter of the receiving member 1301*a* decreases as it goes toward the ink supply needle 1401 due to the inclination of the outer wall surface of the receiving member 1301*a*.

Figure 7A:
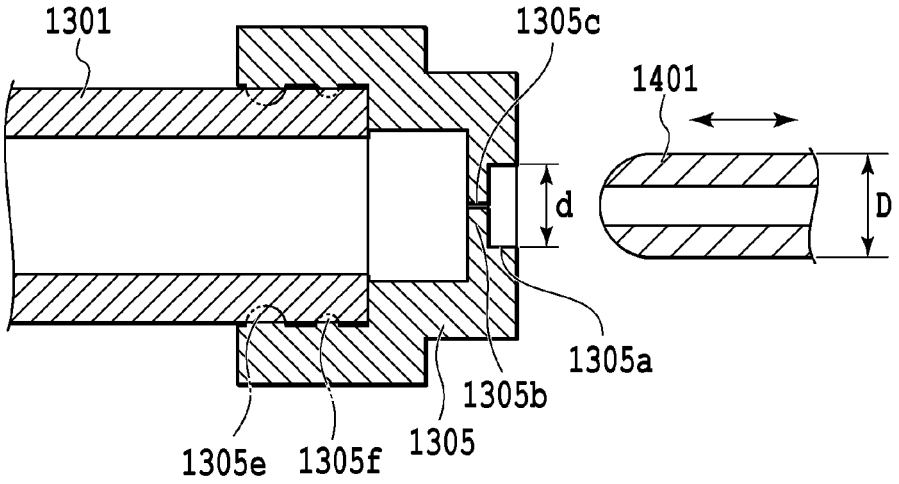
FIG. 7A is a cross-sectional view illustrating a sub-tank, a soft member, and an ink supply needle of a liquid ejection apparatus according to a second embodiment of the present invention
Figure 7B:
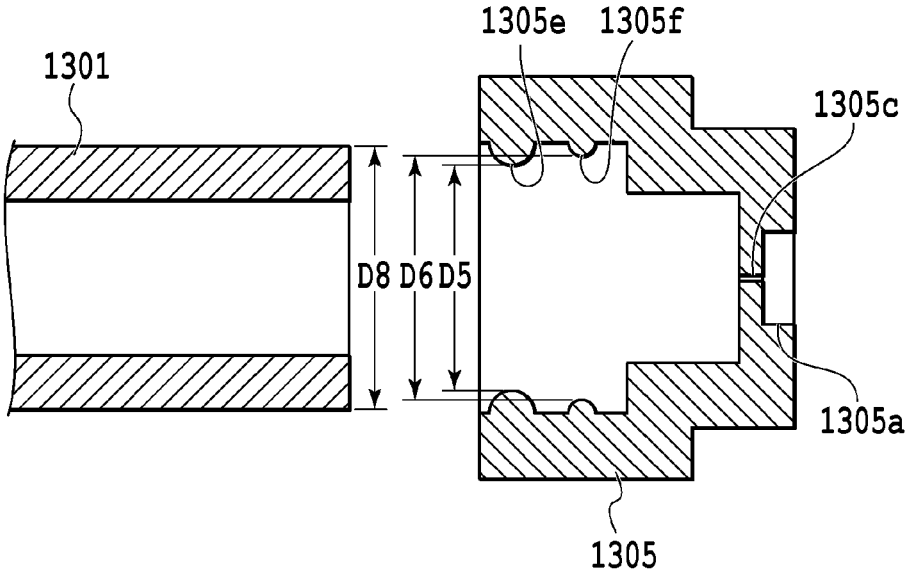
FIG. 7B is a main cross-sectional view illustrating a state where the soft member is not attached to a receiving member of the sub-tank.

In the second embodiment, the inner wall of the receiving member insertion opening 1305*h* of the soft member 1305 is provided with a protrusion portion which protrudes inward. FIGS. 7A and 7B are cross-sectional views illustrating the connection portion between the insertion opening 1305*h* of the soft member 1305 and the receiving member 1301*a* of the sub-tank 1301 of the second embodiment. Since the connection portion is formed between the receiving member 1301*a* and the insertion opening 1305*h* in this way, when the receiving member 1301*a* is inserted into the insertion opening 1305*h*, the receiving member 1301*a* is inserted into the insertion opening 1305*h* while the soft member 1305 is elastically deformed. The protrusion portion is formed so that the inner diameter decreases as it goes toward the sub-tank 1301. That is, the protrusion length of the protrusion portion of the soft member 1305 from the inner wall surface of the insertion opening 1305*h* increases as it goes toward the insertion direction of the ink supply needle 1401. Accordingly, when the receiving member 1301*a* is inserted into the insertion opening 1305*h*, a clamping force of the insertion opening 1305*h* with respect to the receiving member 1301*a* increases as it goes toward the sub-tank 1301.

In the present embodiment, a protrusion portion which protrudes in the inner radial direction is formed at two positions inside the insertion opening 1305*h*. The protrusion portion near the sub-tank 1301 is set as a protrusion portion 1305*e*, and the protrusion portion near the ink supply needle 1401 is set as a protrusion portion 1305*f*. The protrusion portions 1305*e* and 1305*f* are formed in the entire circumference of the inner surface of the insertion opening 1305*h*.

In the present embodiment, regarding the inner diameters of the protrusion portions 1305*e* and 1305*f* inside the insertion opening 1305*h*, the inner diameter of the protrusion portion 1305*e* near the sub-tank 1301 is indicated by D5 and the inner diameter at a position nearest the ink supply needle 1401 is indicated by D6. As illustrated in FIG. 7B, a relation of D5≤D6 is established. Accordingly, the clamping force of the connection portion between the receiving member 1301*a* of the sub-tank 1301 and the insertion opening 1305*h* of the soft member 1305 increases as it goes toward the sub-tank 1301.

Figure 8A:
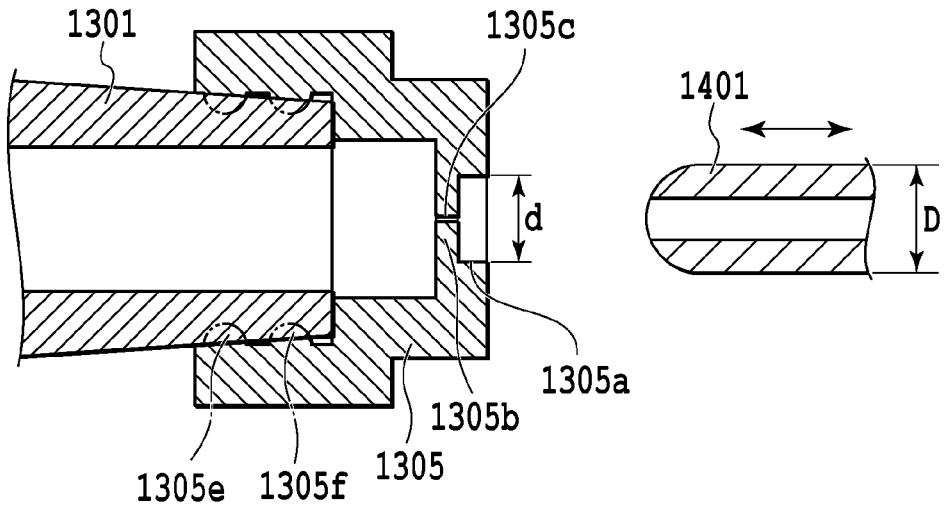
FIG. 8A is a cross-sectional view illustrating a sub-tank, a soft member, and an ink supply needle according to a modified example of the second embodiment of the present invention
Figure 8B:
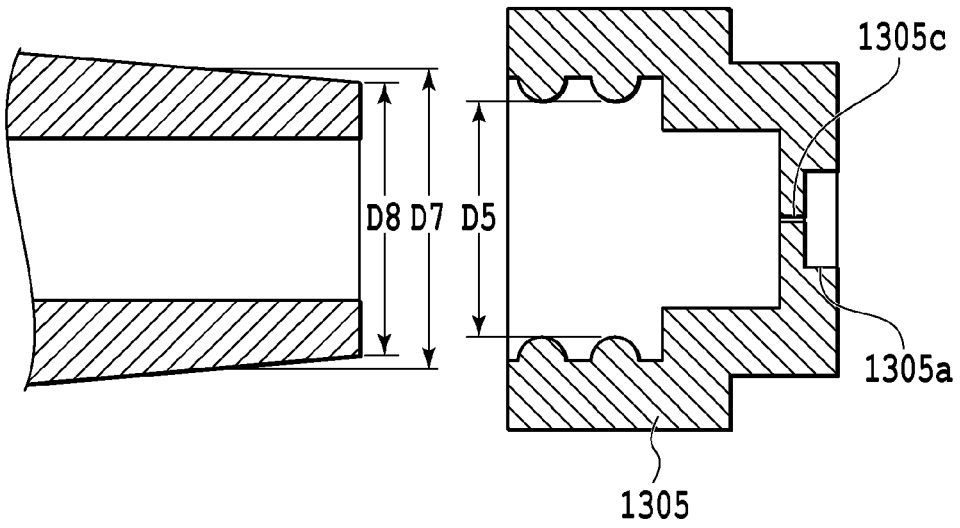
FIG. 8B is a main cross-sectional view illustrating a state where the soft member is not attached to a receiving member of the sub-tank.

Furthermore, the present invention is not limited thereto. As illustrated in FIGS. 8A and 8B, the inner diameter of the protrusion inside the insertion opening 1305*h* may be uniform and the outer diameter of the receiving member 1301*a* may increase as it goes toward the sub-tank 1301. Regarding the outer diameter of the receiving member 1301*a*, the outer shape at a position nearest the ink supply needle 1401 is indicated by D8. Further, regarding the outer diameter of the receiving member 1301*a*, the outer shape at a position nearest the sub-tank 1301 in a portion contacting the inner wall of the insertion opening 1305*h* is indicated by D7. As illustrated in FIG. 8B, a relation of D8≤D7 is established.

In the second embodiment, the outer diameter of the receiving member 1301*a* or the inner diameter of the insertion opening 1305*h* is uniform. However, the present invention is not limited thereto, the outer diameter of the receiving member 1301*a* and the inner diameter of the insertion opening 1305*h* may change. In that case, since the relations of D5≤D6 and D7≤D8 are established, it is desirable to establish a relation of (D8−D6)≤(D7−D5).

Figure 9:
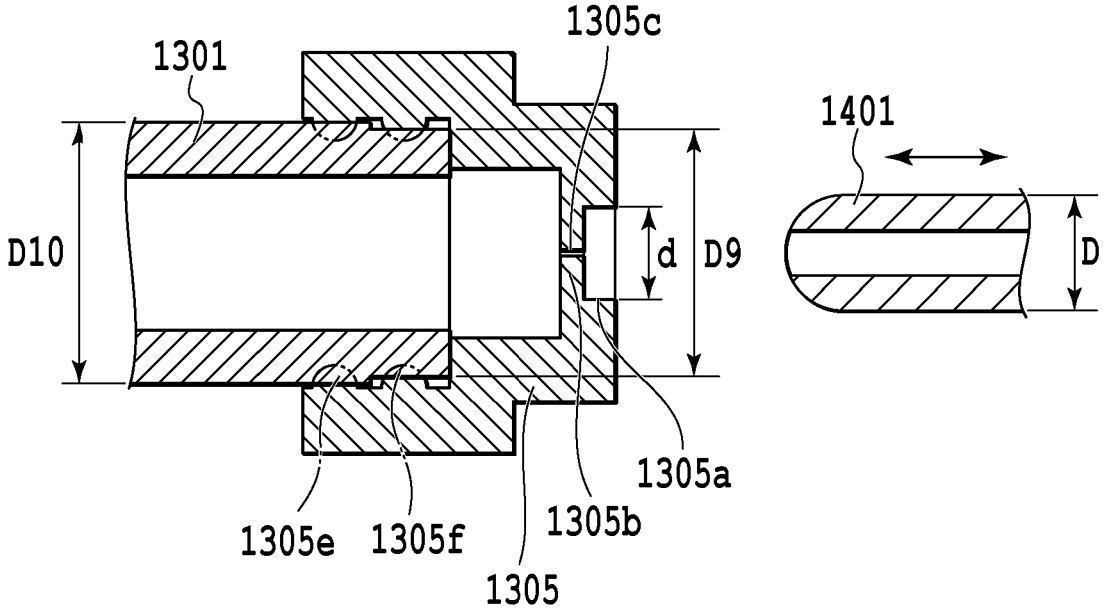
FIG. 9 is a cross-sectional view illustrating a sub-tank, a soft member, and an ink supply needle according to another modified example of the second embodiment of the present invention.

Next, another modified example of the second embodiment will be described. FIG. 9 is a cross-sectional view illustrating the connection portion between the receiving member 1301*a* of the sub-tank 1301 and the insertion opening 1305*h* of the soft member 1305 according to the modified example of the second embodiment.

The modified example has a different configuration in that the outer diameter of the receiving member 1301*a* changes gradually. The inner diameters of the protrusion portions 1305*e* and 1305*f* inside the insertion opening 1305*h* are uniform. Regarding the outer diameter of the receiving member 1301*a*, the outer shape at a position near the ink supply needle 1401 is indicated by D9 and the outer shape at a position near the sub-tank 1301 in a portion contacting the inner wall of the insertion opening 1305*h* is indicated by D10. As illustrated in FIG. 9, a relation of D9≤D10 is established. With such a configuration, the clamping force of the connection portion between the receiving member 1301*a* and the insertion opening 1305*h* increases as it goes toward the sub-tank 1301.

Third Embodiment

Next, a liquid ejection apparatus according to the third embodiment of the present invention will be described. A configuration similar to the first embodiment and the second embodiment will not be described and only a configuration different from the first embodiment will be described.

In the third embodiment, lubricating oil is coated on an area of the soft member 1305 contacting the ink supply needle 1401 when the soft member 1305 holds the ink supply needle 1401. This point is different from those of the first embodiment and the second embodiment.

Figure 10:
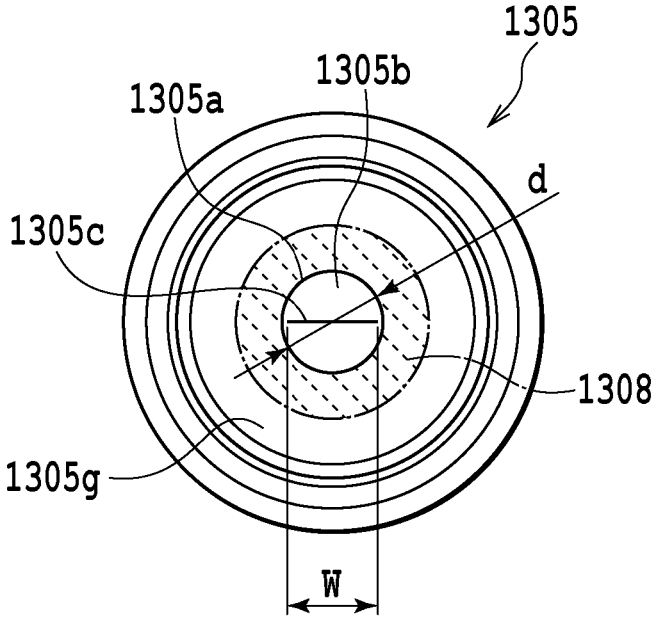
FIG. 10 is a front view illustrating a soft member of a liquid ejection apparatus according to a third embodiment of the present invention.

FIG. 10 is a front view illustrating the soft member 1305 of the third embodiment. In the third embodiment, lubricating oil 1308 as a friction decreasing member for reducing the friction force between the soft member 1305 and the ink supply needle 1401 is coated on a peripheral portion of the insertion opening 1305*a* of the soft member 1305 into which the ink supply needle 1401 is inserted.

Figure 11A:
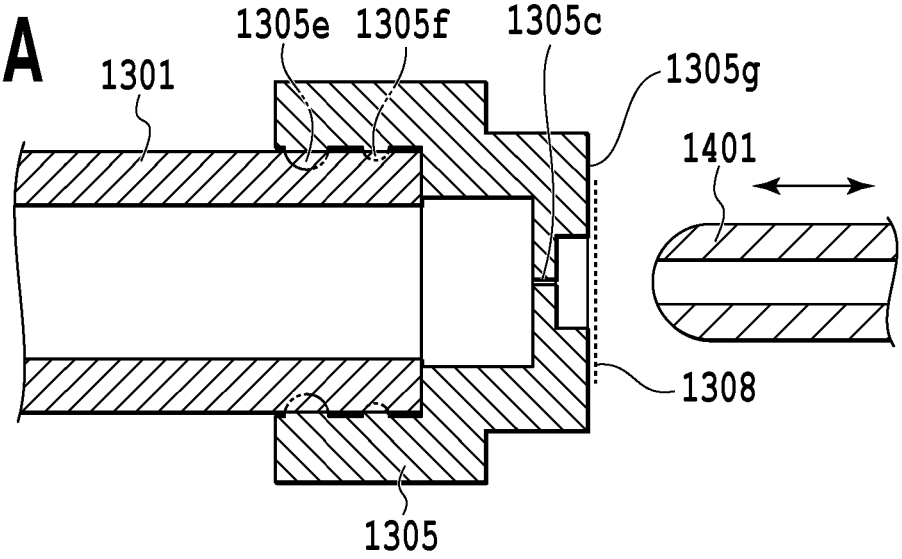
FIG. 11A is a cross-sectional view illustrating the sub-tank, the soft member, and the ink supply needle of FIG. 10.

FIG. 11A is a cross-sectional view illustrating the connection portion between the receiving member 1301*a* of the sub-tank 1301 and the insertion opening 1305*h* of the soft member 1305 of the third embodiment. FIG. 11A is a cross-sectional view illustrating the connection portion in a state where the ink supply needle 1401 is not inserted into the insertion opening 1305*a* yet. Since the lubricating oil 1308 is coated on the peripheral portion of the insertion opening 1305*a* of the soft member 1305 contacting the ink supply needle 1401 when the ink supply needle is inserted, the friction between the soft member 1305 and the ink supply needle 1401 can be decreased.

Figure 11B:
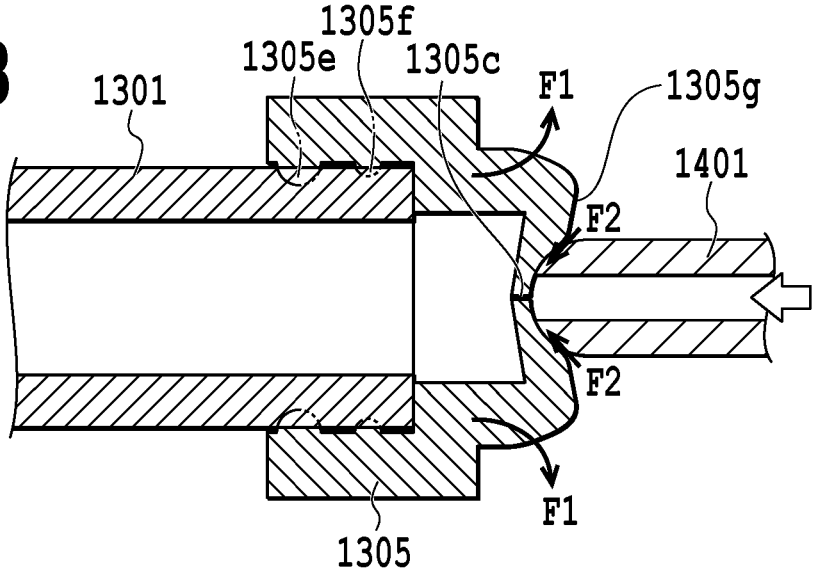
FIG. 11B is a main cross-sectional view illustrating a contact state of the ink supply needle.

FIG. 11B is a cross-sectional view illustrating the connection portion between the receiving member 1301*a* and the insertion opening 1305*h* in a state where the ink supply needle 1401 contacts the peripheral portion of the insertion opening 1305*a*. Since the lubricating oil 1308 is coated on the soft member 1305, the friction between the soft member 1305 and the ink supply needle 1401 is decreased. A friction force exerted between the soft member 1305 and the ink supply needle 1401 at this time is indicated by F2 in FIG. 11B. Further, a repellent force generated when the soft member 1305 is deformed due to a peripheral area of the insertion opening 1305*a* pressed by the ink supply needle 1401 is indicated by F1 in FIG. 11B.

In the present embodiment, since the friction force F2 is decreased by the lubricating oil, the repellent force F1 caused by the soft member 1305 pressed by the ink supply needle 1401 overcomes the friction force F2 (F2<F1). When the ink supply needle 1401 is inserted into the insertion opening 1305*a*, the ink supply needle 1401 is smoothly inserted into the soft member 1305 while the ink supply needle 1401 is not caught by the soft member 1305. For this reason, when the ink supply needle 1401 is inserted into the insertion opening 1305*a*, the deformation amount of the soft member 1305 is suppressed to a small amount.

Since the ink supply needle 1401 is inserted into the soft member 1305 while not being caught by the soft member 1305, the intrusion of air between the ink supply needle 1401 and the soft member 1305 is suppressed. Thus, it is possible to suppress intrusion of the air into the ink when the ink is supplied to the sub-tank 1301 through the ink supply needle 1401. Accordingly, it is possible to efficiently supply the ink to the sub-tank 1301.

Figure 11C:
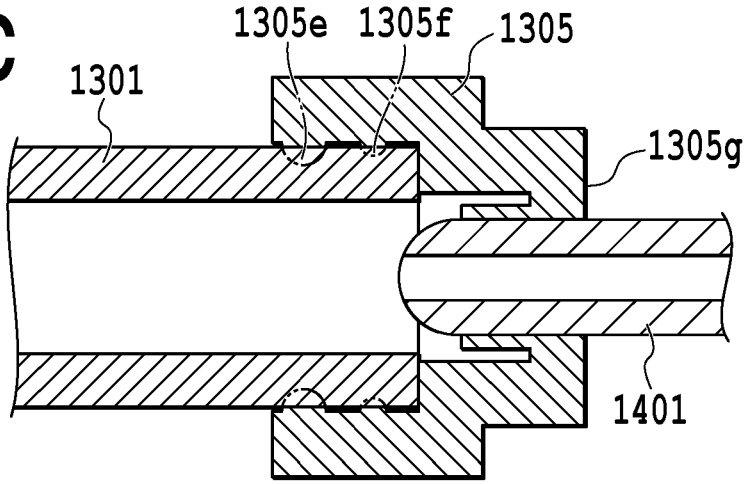
FIG. 11C is a main cross-sectional view illustrating an insertion state of the ink supply needle.

FIG. 11C is a cross-sectional view illustrating the sub-tank 1301, the soft member 1305, and the ink supply needle 1401 in a state where the ink supply needle 1401 is inserted into the insertion opening 1305*a* of the soft member 1305 coated by the lubricating oil 1308. The deformation of the peripheral portion of the insertion opening 1305*a* caused when the ink supply needle 1401 is inserted into the soft member 1305 is suppressed. Thus, when the ink supply needle 1401 is inserted into the insertion opening 1305*a*, the shapes of the slit 1305*c* and the closing thin film 1305*b* follow the shape of the outer periphery of the ink supply needle 1401. Accordingly, the outer surface of the ink supply needle 1401 and the inner surface of the insertion opening 1305*a* continuously come into surface-contact with each other and hence a high sealing property in an area inside the soft member 1305 is ensured. Accordingly, it is possible to efficiently supply the ink to the sub-tank 1301 through the ink supply needle.

In the present embodiment, a nonionic surfactant (acetylenol E100) manufactured by Kawaken Fine Chemicals Co., Ltd. is used as the lubricating oil 1308. As in the first embodiment and the second embodiment, when the lubricating oil 1308 is not coated on the soft member 1305, the static friction coefficient of the soft member 1305 is 0.5 or more. On the contrary, as in the present embodiment, since the lubricating oil 1308 is coated on the soft member 1305, the static friction coefficient decreases to about 0.02. Accordingly, it is possible to sufficiently suppress the deformation of the soft member 1305 when the ink supply needle 1401 is inserted into the soft member 1305. Furthermore, the lubricating oil used herein is not limited thereto, and the other lubricating oil may be used as long as the friction force of the soft member 1305 is decreased.

Further, a method of coating the lubricating oil has been described as a method of decreasing the friction force, but the present invention is not limited thereto. For example, the other methods may be used as long as a method of obtaining a friction force decreasing effect can be obtained by fluorine coating, surface modifying, and rubber blending. Here, when the above-described process is performed on a portion contacting the ink inside the supply passage that supplies the ink from the main tank mounted on the main body toward the printing head, it is desirable to use an element contained in the ink from the viewpoint of an ink resistance or an image influence.

Further, in the present embodiment, the lubricating oil is coated on the soft member of the second embodiment in which the insertion opening 1305*h* is provided with the protrusion portions 1305*e* and 1305*f*, but the present invention is not limited thereto. A configuration may be employed in which the lubricating oil is coated on the soft member of the first embodiment in which the inner wall of the insertion opening 1305*h* is inclined. Further, a configuration may be employed in which the lubricating oil is coated on the other soft members.

Figure 12A:
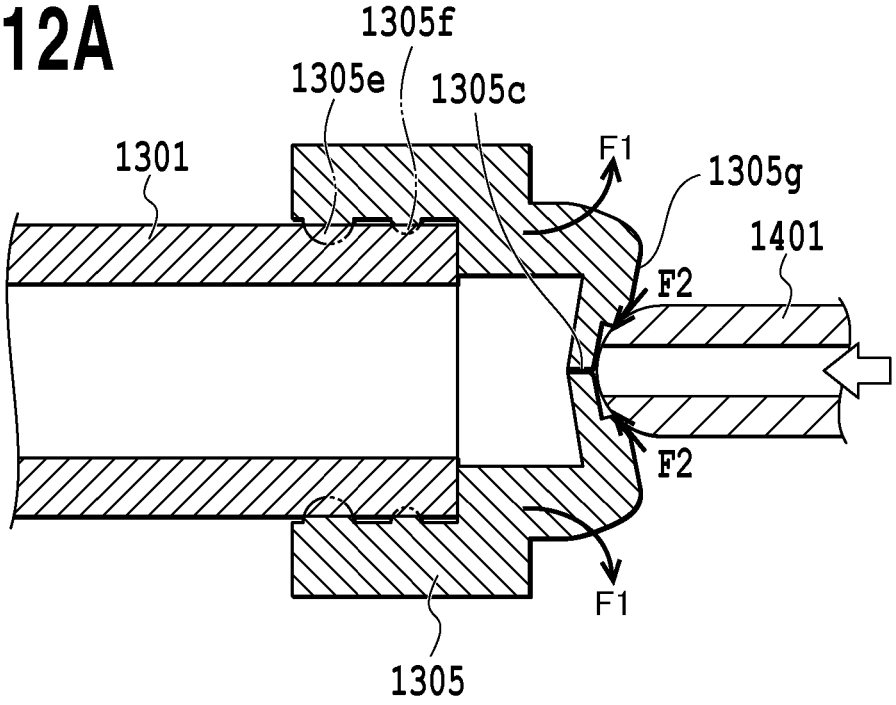
FIG. 12A is a main cross-sectional view illustrating a contact state of an ink supply needle according to a modified example of the third embodiment of the present invention and FIG. 12B is a main cross-sectional view illustrating an insertion state of the ink supply needle.

Next, a comparative example of the third embodiment will be described. FIG. 12A is a cross-sectional view illustrating the sub-tank 1301, the soft member 1305, and the ink supply needle 1401 in a state where the ink supply needle 1401 contacts the peripheral portion of the insertion opening 1305*a* in the comparative example.

In FIG. 12A, a friction force exerted between the soft member 1305 and the ink supply needle 1401 when the ink supply needle 1401 is inserted into the soft member 1305 is indicated by F2. Further, a repellent force generated by the deformation of the soft member 1305 when the peripheral area of the insertion opening 1305*a* is pressed by the ink supply needle 1401 is indicated by F1.

In the comparative example, since the lubricating oil is not coated on the soft member 1305, the friction force between the ink supply needle 1401 and the soft member 1305 does not decrease. Thus, in the comparative example, the friction force F2 is larger than the repellent force F1 to return the soft member 1305 to the original shape (F1<F2). For that reason, when the ink supply needle 1401 is inserted into the soft member 1305, the soft member 1305 is largely deformed inward. As a result, there is a concern that the ink supply needle 1401 may be inserted while air is entangled around the ink supply needle 1401.

Figure 12B:
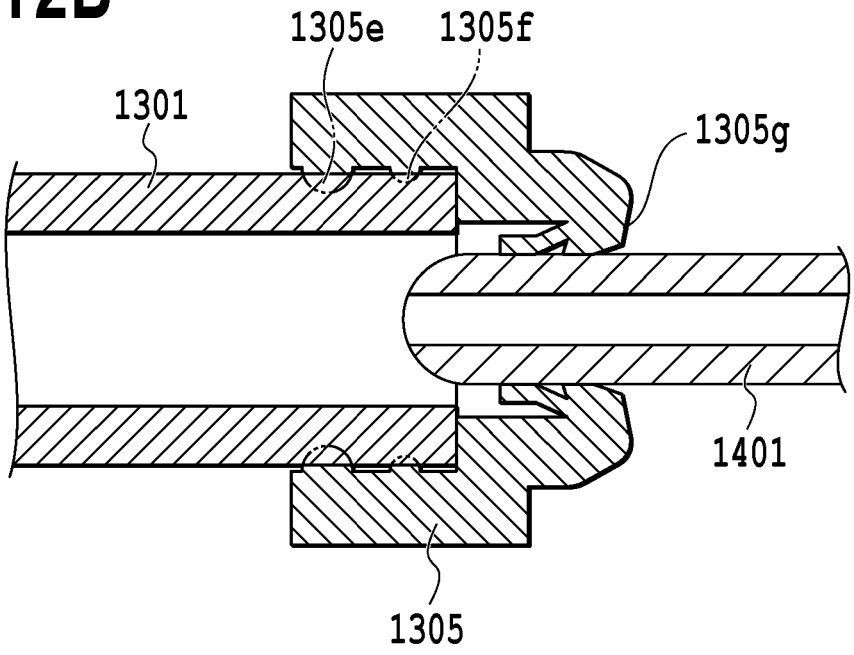

FIG. 12B is a cross-sectional view illustrating the sub-tank 1301, the soft member 1305, and the ink supply needle 1401 when the ink supply needle 1401 is inserted in the comparative example. As illustrated in FIG. 12B, the soft member 1305 is comparatively largely deformed by the friction between the ink supply needle 1401 and the insertion opening 1305*a* when the ink supply needle 1401 is inserted into the insertion opening 1305*a*.

In the comparative example, since the friction between the ink supply needle 1401 and the soft member 1305 is comparatively large, the outer wall of the ink supply needle 1401 is caught by the inner wall of the soft member 1305 when the ink supply needle 1401 is inserted into the insertion opening 1305*a*. Thus, as illustrated in FIG. 12B, there is a concern that the ink supply needle 1401 may be inserted into the insertion opening 1305*a* while entangling the peripheral air. In the comparative example, the ink supply needle 1401 is inserted into the soft member 1305 while the seal surface (inner surface of the insertion opening 1305*a*) does not sufficiently contact the outer periphery of the ink supply needle 1401.

In such a case, the ink supply needle 1401 and the soft member 1305 do not sufficiently come into surface-contact with each other so that the sealed state inside the soft member 1305 is not kept. Thus, when the ink is supplied from the ink supply needle 1401 toward the sub-tank 1301, an air passage is formed with respect to the external air and hence the ink supply performance may decrease. Accordingly, there is a possibility that the ink supply efficiency may decrease.

On the contrary, in the third embodiment of the present invention, the lubricating oil 1308 is coated on the soft member 1305. Thus, since the ink supply needle 1401 is inserted while not being caught by the soft member 1305, the intrusion of the air between the ink supply needle 1401 and the soft member 1305 is suppressed. Thus, it is possible to suppress the air from intruding into the ink when the ink is supplied toward the sub-tank 1301 through the ink supply needle 1401. Further, since the slit 1305*c* and the closing thin film 1305*b* follow the shape of the outer periphery of the ink supply needle 1401, the ink supply needle 1401 and the insertion opening 1305*a* continuously come into surface-contact with each other and hence the sealing property inside the soft member 1305 is ensured. Accordingly, it is possible to efficiently supply the ink toward the sub-tank 1301 through the ink supply needle.

Further, in the above-described embodiments, the liquid ejection apparatus has been described which supplies the liquid to the liquid ejection head through the tube and ejects the liquid from the liquid ejection head, but the present invention is not limited thereto. For example, the present invention can be applied to a supply mechanism that supplies an ink collected by a cleaning operation for the liquid ejection head to a waste ink tank. Specifically, the present invention can be applied to an attachment assembly to which a supply member such as a needle and a receiving member such as a soft member are attached in a liquid supply unit of the liquid ejection apparatus.

Fourth Embodiment

Next, a liquid ejection apparatus according to the fourth embodiment of the present invention will be described.

Figure 13A:
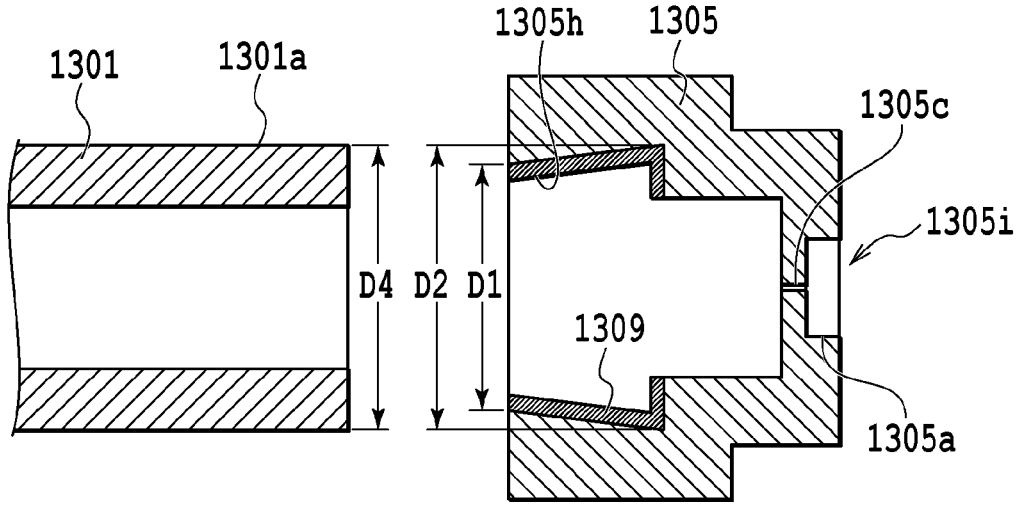
FIGS. 13A and 13B are main cross-sectional views respectively illustrating different examples of a fourth embodiment of the present invention.
Figure 13B:
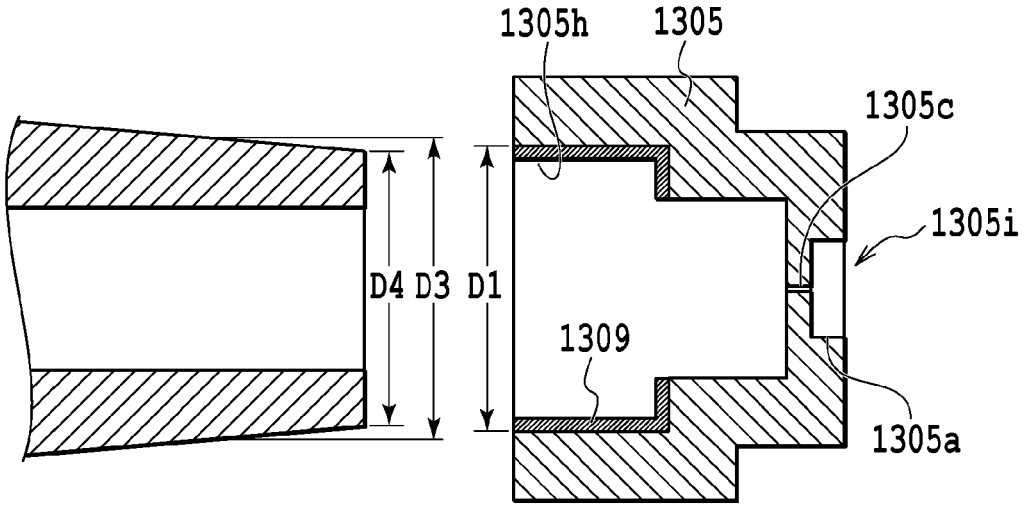
Figure 14A:
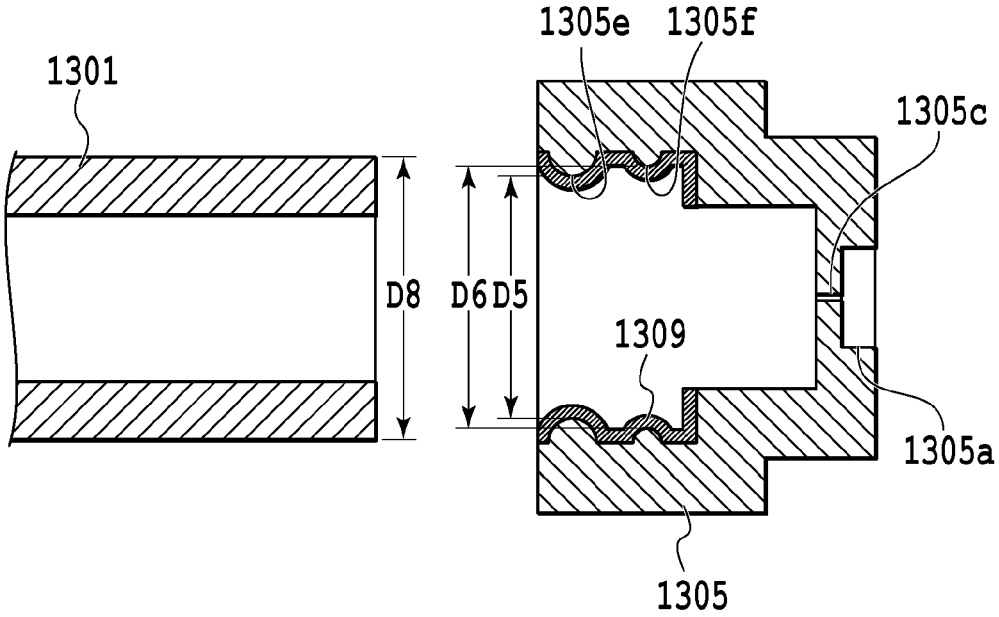
FIGS. 14A and 14B are main cross-sectional views respectively illustrating different examples of the fourth embodiment of the present invention.
Figure 14B:
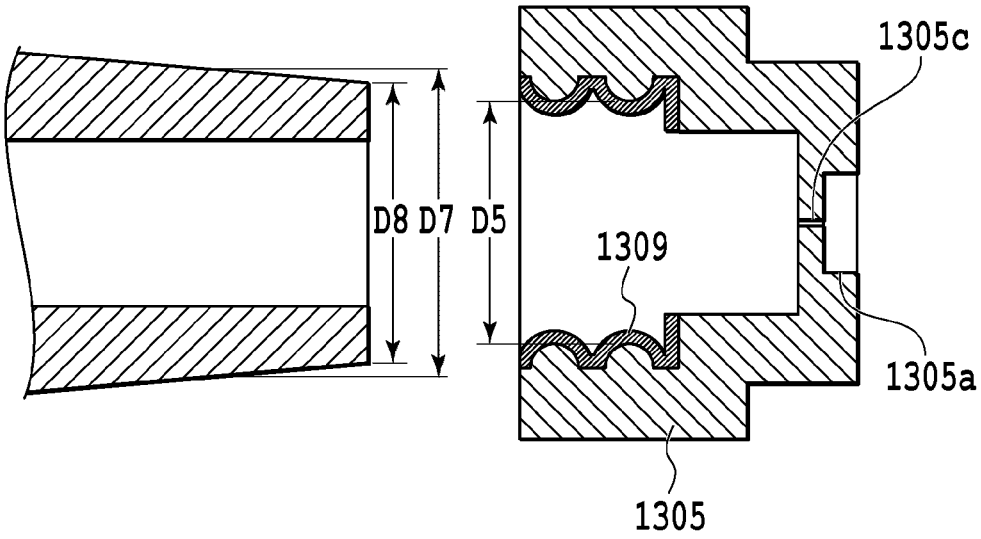

In the present embodiment, as in FIGS. 13A, 13B, 14A, and 14B, a high-volatile solvent (ethanol) 1309 is coated on the insertion opening 1305*h* of the soft member 1305 into which the receiving member 1301*a* of the sub-tank 1301 is inserted. In the examples of FIGS. 13A and 13B, the high-volatile solvent 1309 is coated on the insertion opening 1305*h* of the soft member 1305 in FIGS. 5B and 5C. In the examples of FIGS. 14A and 14B, the high-volatile solvent 1309 is coated on the insertion opening 1305*h* of the soft member 1305 of FIGS. 7B and 8B. The high-volatile solvent 1309 is coated on only the area of the insertion opening 1305*h* contacting the receiving member 1301*a*.

When the receiving member 1301*a* is inserted into the insertion opening 1305*h*, the soft member 1305 is rotated. Since the high-volatile solvent 1309 is coated, it is possible to decrease a friction force generated when the receiving member 1301*a* is inserted into the insertion opening 1305*h* and to suppress the repellent force of the soft member 1305. As a result, it is possible to improve the insertability of the receiving member 1301*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-110168, filed May 29, 2015, No. 2016-028308, filed Feb. 17, 2016 which are hereby incorporated by reference wherein in their entirety.

What is claimed is:

1. A liquid ejection apparatus comprising:

a supply member that includes a supply opening and is constructed to supply a liquid from the supply opening;

a liquid ejection head that is constructed to eject a liquid;

a receiving member having first and second ends, the receiving member being connected to the liquid ejection head at the first end, the receiving member being constructed to receive the supply member at the second end, and the receiving member further being constructed to supply the liquid supplied from the supply member to the liquid ejection head in a case where the second end of the receiving member receives the supply member; and an elastic holding member that is attached to the second end of the receiving member, wherein one end of the elastic holding member is provided with a first insertion opening into which the supply member is inserted and is provided with a film member for blocking the first insertion opening, and wherein another end of the elastic holding member is provided with a second insertion opening communicating with the first insertion opening and into which the second end of the receiving member is inserted, wherein an inner diameter of the second insertion opening is smaller than an outer diameter of the second end of the receiving member at a position where the second end of the receiving member is inserted to the second insertion opening of the elastic holding member, so as to urge the film member in a direction in which the first insertion opening is blocked by deformation of the elastic holding member in a case where the second end of the receiving member is inserted to the second insertion opening of the elastic holding member.

2. The liquid ejection apparatus according to claim 1, wherein two film members are disposed at the one end of the elastic holding member at positions opposed to each other with the center of the first insertion opening interposed therebetween.

3. The liquid ejection apparatus according to claim 2, wherein in a case where the second end of the receiving member is inserted to the second insertion opening of the elastic holding member, each film member is urged while being pressed in a direction toward the center of the first insertion opening.

4. The liquid ejection apparatus according to claim 1, wherein in the case where the second end of the receiving member is not inserted to the second insertion opening of the elastic holding member, a difference between the outer diameter of the second end of the receiving member and the inner diameter of the second insertion opening increases as it goes toward the first end of the receiving member.

5. The liquid ejection apparatus according to claim 1, wherein in a case where the second end of the receiving member is inserted to the second insertion opening of the elastic holding member, a force in which the second insertion opening of the elastic holding member clamps the second end of the receiving member inward increases as it goes toward the first end of the receiving member.

6. The liquid ejection apparatus according to claim 1, wherein an area of the elastic holding member contacting the supply member is provided with a friction decreasing portion, the friction decreasing portion decreasing a friction force between the elastic holding member and the supply member in a case where the supply member is inserted to the first insertion opening of the elastic holding member.

7. An attachment assembly, for a liquid supply portion, provided in a liquid ejection apparatus including a liquid ejection head ejecting a liquid, comprising:

a supply member that includes a supply opening and is constructed to supply the liquid from the supply opening;

a receiving member having first and second ends, the receiving member being constructed to receive the supply member at the second end and to receive the liquid from the supply member in a case where the second end of the receiving member receives the supply member; and an elastic holding member that is attached to the second end of the receiving member, wherein one end of the elastic holding member is provided with a first insertion opening into which the supply member is inserted and is provided with a film member for blocking the first insertion opening, and wherein another end of the elastic holding member is provided with a second insertion opening communicating with the first insertion opening and into which the second end of the receiving member is inserted, wherein an inner diameter of the second insertion opening is smaller than an outer diameter of the second end of the receiving member at a position where the second end of the receiving member is inserted to the second insertion opening of the elastic holding member, so as to urge the film member in a direction in which the first insertion opening is blocked by deformation of the elastic holding member in a case where the second end of the receiving member is inserted to the second insertion opening of the elastic holding member.

8. The attachment assembly according to claim 7, wherein two film members are disposed at the one end of the elastic holding member at positions opposed to each other with the center of the first insertion opening interposed therebetween.

9. The attachment assembly according to claim 8, wherein in a case where the second end of the receiving member is inserted to the second insertion opening of the elastic holding member, each film member is urged while being pressed in a direction toward the center of the first insertion opening.

10. The attachment assembly according to claim 7, wherein in the case where the second end of the receiving member is not inserted to the second insertion opening of the elastic holding member, a difference between the outer diameter of the second end of the receiving member and the inner diameter of the second insertion opening increases as it goes toward the first end of the receiving member.

11. The attachment assembly according to claim 7, wherein in a case where the second end of the receiving member is inserted to the second insertion opening of the elastic holding member, a force in which the second insertion opening of the elastic holding member clamps the second end of the receiving member inward increases as it goes toward the first end of the receiving member.

12. The attachment assembly according to claim 7, wherein an area of the elastic holding member contacting the supply member is provided with a friction decreasing portion, the friction decreasing portion decreasing a friction force between the elastic holding member and the supply member in a case where the supply member is inserted to the first insertion opening of the elastic holding member.

13. The liquid ejection apparatus according to claim 1, wherein in the case where the second end of the receiving member is not inserted to the second insertion opening of the elastic holding member, an inner diameter of a first portion of the second insertion opening being smaller than an outer diameter of a second portion of the receiving member corresponding to the first portion by a first length, an inner diameter of a third portion of the second insertion opening near to the first insertion opening than the first portion being smaller than an outer diameter of a fourth portion of the receiving member corresponding to the third portion by second length, the first length is larger than the second length.

14. The attachment assembly according to claim 7, wherein in the case where the second end of the receiving member is not inserted to the second insertion opening of the elastic holding member, an inner diameter of a first portion of the second insertion opening being smaller than an outer diameter of a second portion of the receiving member corresponding to the first portion by a first length, an inner diameter of a third portion of the second insertion opening near to the first insertion opening than the first portion being smaller than an outer diameter of a fourth portion of the receiving member corresponding to the third portion by second length, the first length is larger than the second length.

* * * * *